United States Patent [19]

Chang et al.

[11] Patent Number: 4,653,727

[45] Date of Patent: Mar. 31, 1987

[54] MOTOR DRIVEN SCISSORS JACK FOR AUTOMOBILES

[76] Inventors: Shoei D. Chang; Huey S. Liaw, both of 11, Lane 250, Sec. 1, Kuo Guang Rd., Da Li Hsien, Taiwan

[21] Appl. No.: 830,924

[22] Filed: Feb. 19, 1986

[51] Int. Cl.[4] ..... B66F 3/12

[52] U.S. Cl. ..... 254/1; 254/126; 254/DIG. 2

[58] Field of Search ..... 254/122, 126, DIG. 2, 254/424, 425, 98, 1

[56] References Cited

U.S. PATENT DOCUMENTS 3,645,501 2/1972 Musgrove ..... 254/126
3,888,464 6/1975 Felsen ..... 254/425
3,997,143 12/1976 Rose ..... 254/122
4,025,054 5/1977 Yamazaki ..... 254/126

*Primary Examiner*—Robert C. Watson
*Attorney, Agent, or Firm*—Cushman, Darby & Cushman

[57] ABSTRACT

The invention relates to motor driven scissors jacks for automobiles and is driven by the electric power source from the cigarette lighting socket of any automobile. Its DC motor is driven through a deceleration gear box for rotating a screw rod clockwise or counter-clockwise in order to provide for the raising of the frames of scissors jacks with automatic raising of vehicles and for the higher raising and lower collapsing functions and a more powerful raising capability. It is also provided with one ultimate switch for peak and low bottom points in order to limit its raising and collapsing operation to fixed points and an automatic stop for safe raising operations and for preventing damage to the motor.

1 Claim, 3 Drawing Figures

MOTOR DRIVEN SCISSORS JACK FOR AUTOMOBILES

BACKGROUND OF THE INVENTION

The present invention relates to motor driven scissors jacks for automobiles, and, more particularly, to jacks furnished with a screw rod driven by a deceleration motor for mechanical driving in order to ensure safe raising operation.

The prevailing jack models can be classified into two basic types, mechanical and hydraulic oil jacks, both of which have their weak points for daily use. The mechanical jack is driven by a screw rod which is operated manually to raise the lever frames with a long rod inserted into an open groove for rotating the rod and is inconvenient, toilsome and very time-consuming. This type is compact in size for carrying, but inconvenient for use. Therefore, few users choose it. The other model, the hydraulic oil jack, can save labor, but features a rather complicated structure, being too bulky in size to be carried in a car. It is dangerous for its high lowering speed in use and oil leakage and is therefore not an ideal jack for the users.

SUMMARY OF THE INVENTION

It is an object of the present invention to provide a motor driven scissors jack for automobiles which features a lower collapsing position, simple structure, easy carrying in a car and DC motor for ideal lifting or lowering by means of a screw rod rotation.

In accordance with the present invention a motor driven scissors jack for automobiles includes a U-shaped bracket installed on a rectangular base seat, two lower raising rods interlocked with the U-shaped bracket, the ends of these lower raising rods being engaged with ratchet gearing with the other ends respectively interlocked with a round screw fixture and a screw rod fixture. Two upper raising rods ends are also engaged with ratchet gearing and also interlocked with another U-shaped bracket. A rubber washer is fixed on the other U-shaped bracket. A DC motor is located on the outside of the screw rod fixture and drives the screw rod which screws down and penetrates a round screw fixture by means of a deceleration gear box. An ultimate switch is installed on the side of lower raising rod and switches off the power supply by pushing off the flange of lower raising rod. Furthermore, a controller is furnished to the power cord of DC motor, and an illumination lamp is fixed on the controller. The plug of power cord is cylindrical and insertable into the cigarette lighting socket of a car.

The present invention advantageously takes its power from the cigarette lighting socket of a car and can be easily operated for lifting and lowering safely and is convenient and labor-saving. Being of mechanical design, there is no oil leakage or improper danger. The lifting and lowering speeds are also steady. It is compact in size, easy to carry, easy to fix, has night-time illumination facility and easy to use.

A principal objective of the present invention is, therefore, the provision of an improved motor driven scissors jack for automobiles. Other objects and further scope of applicability of the present invention will become apparent from the detailed description to follow, taken in conjunction with the accompanying drawings, in which like parts are designated by like reference characters.

DESCRIPTION OF THE PREFERRED EMBODIMENT

Figure 1:
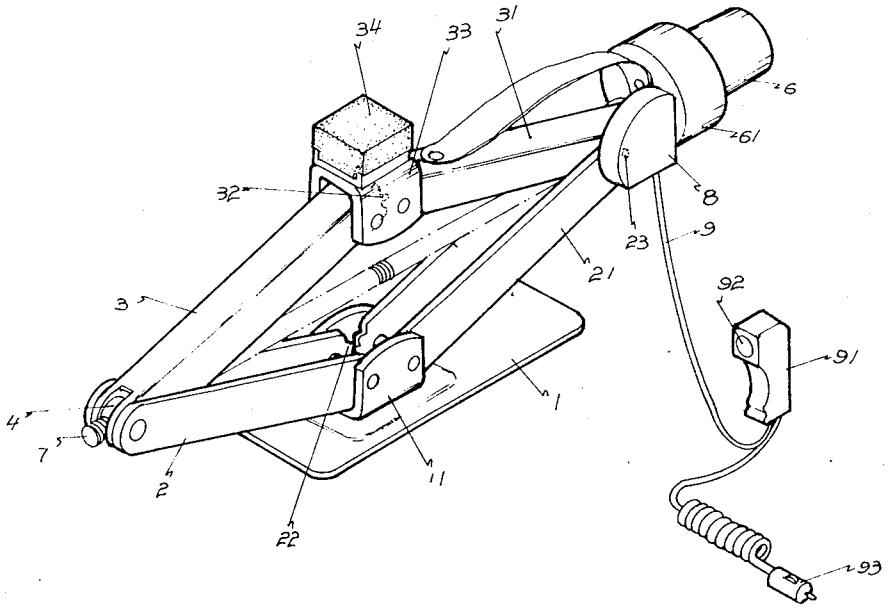
FIG. 1 is a side, perspective view of the inventor.
Figure 3:
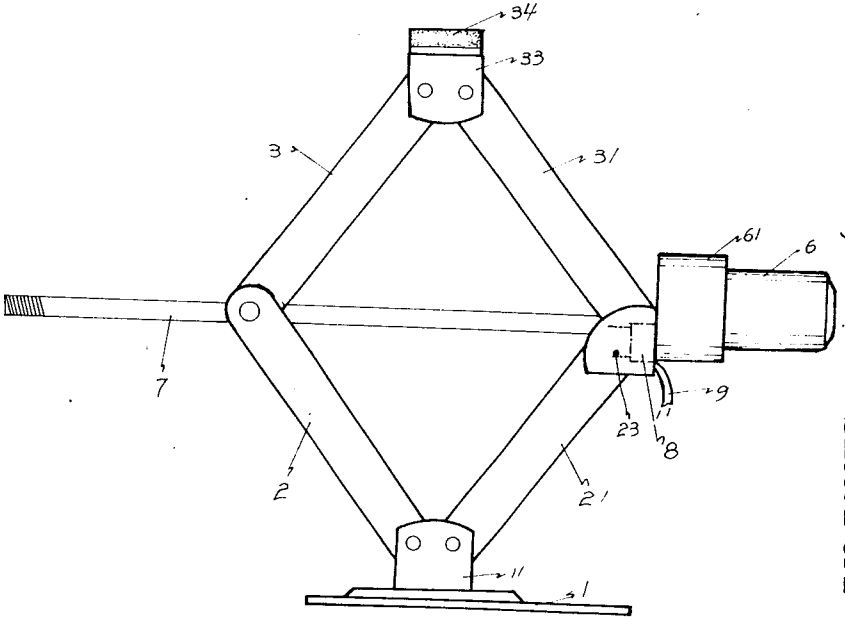
FIG. 3 is a side view of the invention in a lifted position.
Figure 2:
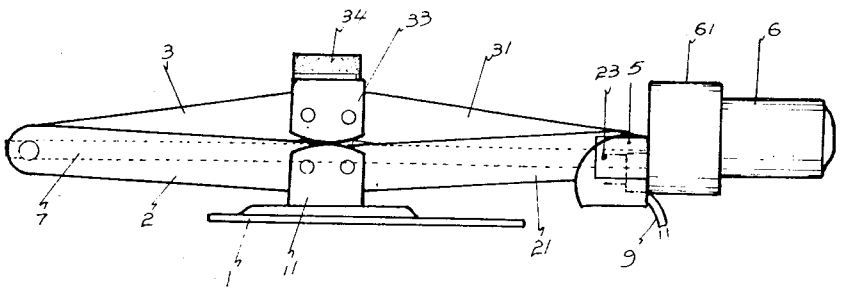
FIG. 2 is a side view of the invention in a collapsed position.

As shown in FIG. 1, a U-shaped bracket 11 is installed on a rectangular base seat 1. In the U-shaped bracket 11, two lower raising rods 2 and 21 are mutually interlocked with each other and with the bracket and with the two lower raising rods 2 and 21 mutually engaged with each other's gears. The other ends of lower raising rod 2 and 21 are interlocked with the two ends of upper raising rods 3 and 31 by means of a round screw fixture 4 and a screw rod fixture 5 (FIG. 2). The other two ends of the upper raising rods 3 and 31 are also engaged with each others gears and interlocked with a U-shaped bracket 33. A piece of rubber washer 34 is fixed upon the U-shaped bracket 33. A DC motor 6 is installed on the side of the screw rod fixture 5. The DC motor 6 drives a screw rod 7 which screws down and pierces through the round screw fixture 4 by means of a deceleration gear box 61. An ultimate switch 8 is installed on the side of the lower raising rod 21, and can be switched off by a flange 23 of the lower raising rod 21. A controller 91 is fixed on the power cord 9 of the motor 6, and an illumination lamp 92 is furnished on the controller 91. A cylindrical plug 93 can be inserted into a cigarette lighting socket in a car to provide electrical power.

In order to operate the jack, the plug 93 is inserted into the cigarette lighting socket of a car, and a switch on the controller 91 operated to start the DC motor 6. The motor 6 rotates the screw rod 7 through the deceleration gear box 61. The round screw fixture 4 is pushed forward by means of the threads of screw rod 7, and results in a lifting effect upon the lowering raising rod 2 and 21 and upper raising rods 3 and 31. In the case of lowering, another switch on the controller 91 is pushed for counter-rotating the screw rod 7 for lowering. In the case of lifting or lowering to a fixed point, the flange 23 of lower raising rod 21 will push the snapping rod 81 of the ultimate switch 8 for automatically shutting off the power supply. The illumination lamp 92 can be used for night operation.

Thus it will be appreciated from the above that as a result of the present invention, an improved motor driven scissors jack for automobiles is provided by which the principal objective, among others, is completely fulfilled. It will be equally apparent and is contemplated that modification and/or changes may be made in the illustrated embodiment without departure from the invention. Accordingly, it is expressly intended that the foregoing description and accompanying drawings are illustrative of preferred embodiments only, not limiting, and that the true split and scope of the present invention will be determined by reference to the appended claims.

What is claimed is:

1. A motor driven scissors jack for automobiles comprising:

a base plate having a bracket secured thereto;

first and second raising links pivotably connected at respective first ends to said bracket and having respective interengaging gear sectors at said first ends;

third and fourth raising links pivotably connected at respective first ends to another bracket and having respective interengaging gear sectors at said first ends thereof;

said first and third raising links and said second and fourth raising links pivotably connected, respectively, at their other ends;

screw drive means for selectively raising and lowering said other bracket relative to said first-mentioned bracket, said screw drive means including a screw rod engagable with screw rod fixtures at the pivotably connected other ends of said raising links, a gear box connected to said screw rod, and an electric motor connected to said gear box to rotate said screw rod in a first direction to raise said jack and a second direction to lower said jack; and means for delivering electrical power to said motor and effecting control thereof including a power line having a connector for insertion into the cigarette lighter socket of an automobile, limit switch means for interrupting the electrical power at a predetermined position of said raising links, a user operable handle connected in said power line having a switch means for controlling the application of electrical power to said motor to effect rotation in one direction or the other direction, and illumination means mounted in said handle for selectively providing illumination.

* * * * *